US005259914A

United States Patent [19]

Fisher

[11] Patent Number: 5,259,914

[45] Date of Patent: Nov. 9, 1993

[54] PORTABLE VEHICLE ADHESIVE REMOVER FOR REMOVING PINSTRIPES, DECALS, SIDE MOLDINGS AND OTHER ADHERED ITEMS FROM A VEHICLE

[75] Inventor: Irving Fisher, Sherman Oaks, Calif.

[73] Assignee: Fisher Tool Co., Inc., Los Angeles, Calif.

[21] Appl. No.: 719,948

[22] Filed: Jun. 24, 1991

[51] Int. Cl.[5] ..... B32B 35/00

[52] U.S. Cl. ..... 156/584; 156/344; 51/170 PT; 408/226

[58] Field of Search ..... 156/344, 584, 154; 15/59, 60, 65, 68, 424, 425; 51/170 PT; 279/7; 408/226

[56] References Cited

U.S. PATENT DOCUMENTS

| | | | |
|---|---|---|---|
| 856,323 | 6/1907 | Wickes | 156/344 X |
| 2,545,453 | 3/1951 | Forss | 51/170 PT |
| 2,570,009 | 10/1951 | Schmid | 51/170 PT |
| 2,607,232 | 8/1952 | Haase | 51/170 PT |
| 2,854,286 | 9/1958 | Salick | 156/204 X |
| 3,104,569 | 9/1963 | Davis et al. | 279/7 |
| 4,150,955 | 4/1979 | Samuelson | 51/298 |
| 4,197,061 | 4/1980 | Hill | 418/173 |
| 4,629,374 | 12/1986 | Berner | 279/7 X |
| 4,690,724 | 9/1987 | Outlaw | 156/344 X |
| 4,866,319 | 9/1989 | Crutchfield | 51/170 PTX |
| 5,005,807 | 4/1991 | Mathews et al. | 408/226 X |
| 5,042,207 | 8/1991 | Kirn | 51/170 PTX |
| 5,190,620 | 3/1993 | Winter | 156/344 |

FOREIGN PATENT DOCUMENTS

| | | | |
|---|---|---|---|
| 3030351 | 3/1982 | Fed. Rep. of Germany | 156/344 |
| 2084059 | 4/1982 | United Kingdom | 51/170 PT |
| 2114925 | 9/1983 | United Kingdom | 51/170 PT |

OTHER PUBLICATIONS

Astro Pneumatic Tool Company, Advertisement.

*Primary Examiner*—David A. Simmons
*Assistant Examiner*—Mark A. Osele
*Attorney, Agent, or Firm*—Thomas I. Rozsa; Dong Chen

[57] ABSTRACT

The present invention is a portable vehicle adhesive remover having (a) a motor unit assembled inside a housing including a throttler, a rotor and a gear assembly where the motor unit has an elongated spindle extending out from the top opening of the housing; (b) an extending shank having a proximal end attached to the elongated spindle of the motor unit and a distal end; and (c) an eraser unit attached to the distal end of the extending shank including a resilient eraser member and a disc member embedded in the eraser member. When the eraser unit and the motor unit are attached and a high pressure compressed air is sent into the bottom opening of the housing, the compressed air will be gushed into the rotor by the throttler assembly, which in turn will drive the eraser unit through the gear assembly and cause the resilient eraser member to rotate at a high speed. When the a high speed rotating eraser member is engaged to pinstripes, decals, side moldings and other adhered items, it can generate adequate heat to cause the adhesive to lose its adhesion and thus release the pinstripes, decals, side moldings and other adhered items, so they can be removed without damaging the paint or other body parts of the vehicle.

6 Claims, 3 Drawing Sheets

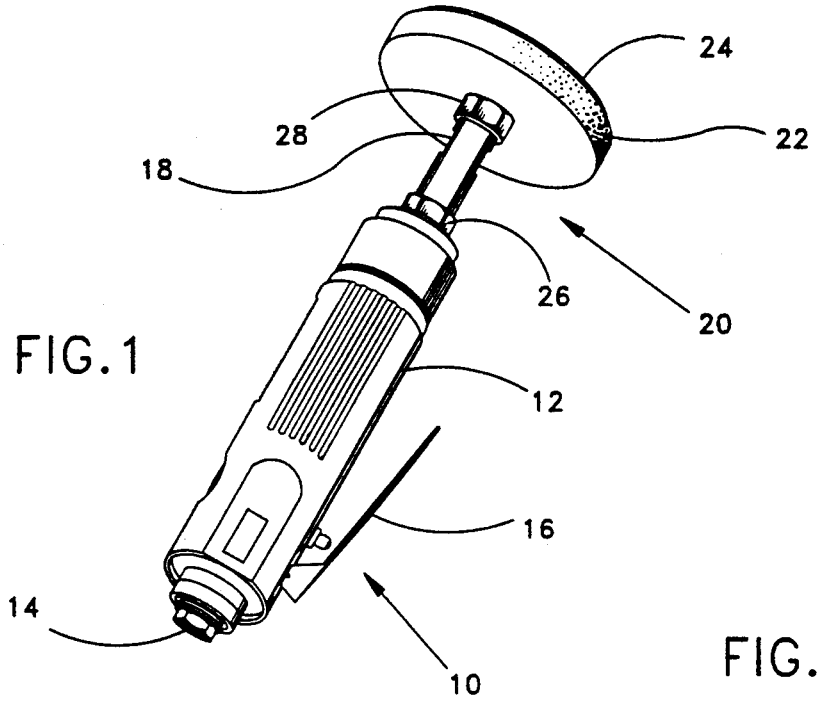
FIG. 1
FIG. 3
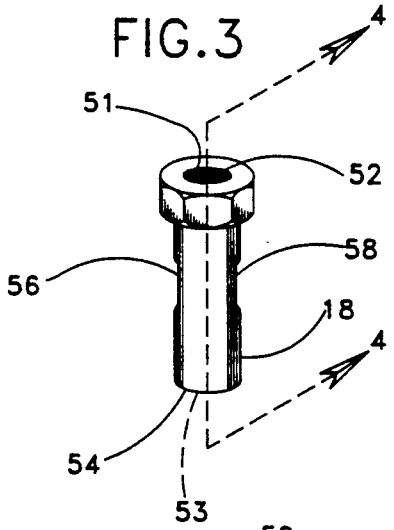
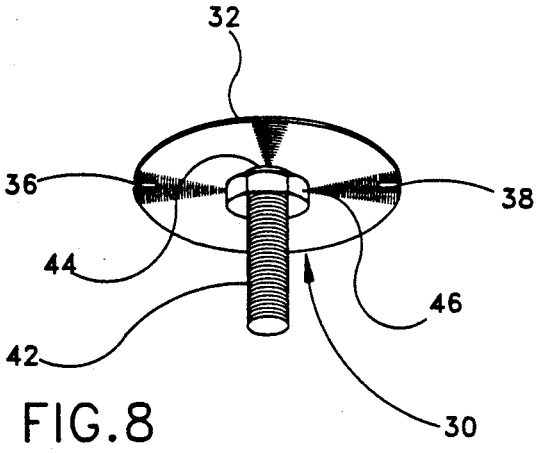
FIG. 8
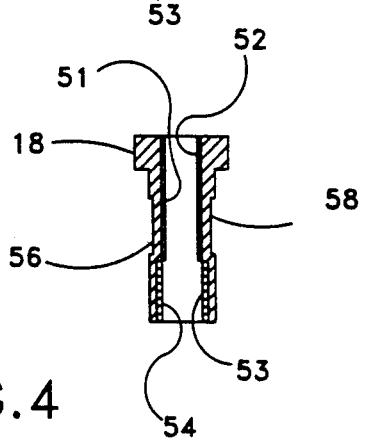
FIG. 4
Section on line 4 – 4

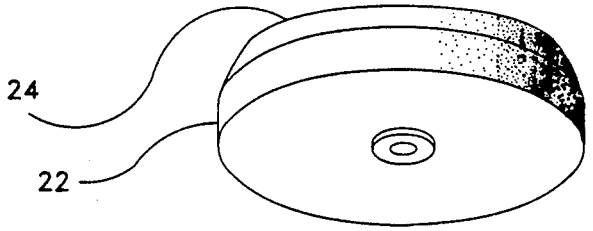
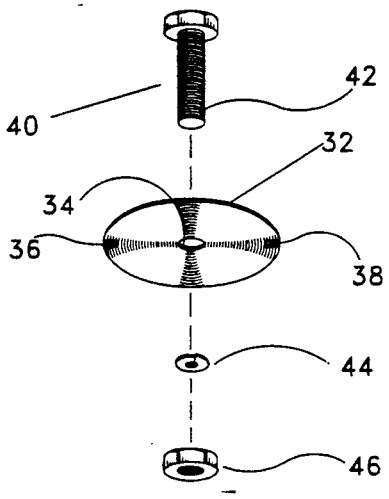
FIG.5
FIG.6
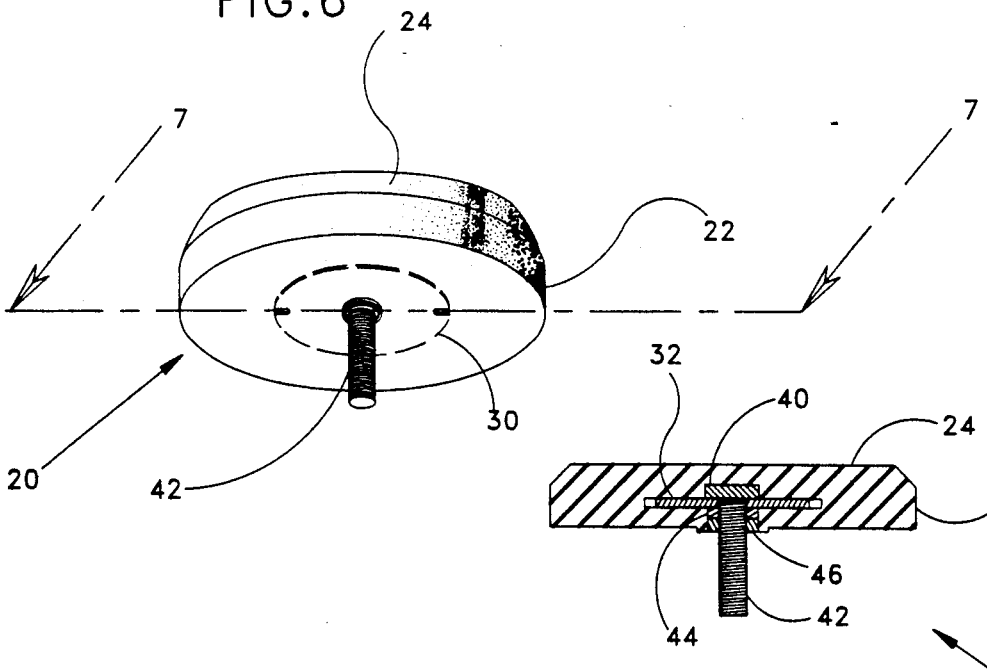
FIG.7
Section on line 7 – 7

PORTABLE VEHICLE ADHESIVE REMOVER FOR REMOVING PINSTRIPES, DECALS, SIDE MOLDINGS AND OTHER ADHERED ITEMS FROM A VEHICLE

BACKGROUND OF THE INVENTION

1. Field of The Invention

The present invention relates to the automobile and other vehicle manufacture and service industries. More particularly, the present invention relates to portable power tools designed and built for removing vehicle adhesive to remove pinstripes, decals, side moldings and other adhered items from a vehicle.

2. Description of The Prior Art

In automobile and other vehicle manufacture and service industries, people often need to remove pinstripes, decals, side moldings and other adhered items from the bodies of vehicles such as trucks or automobiles. Traditionally it is done by peeling, scratching or sanding off the pinstripes, decals, side moldings, etc. However, these traditional methods usually leave damage the original paint on the bodies of the vehicles.

There is a significant need for an improved method to remove the pinstripes, decals, side moldings and other adhered items from a vehicle without damaging the paint on the vehicle.

SUMMARY OF THE PRESENT INVENTION

The present invention is a portable vehicle adhesive remover for removing pinstripes, decals, side moldings and other adhered items from a vehicle without damaging the paint or other body parts of the vehicle.

It has been discovered, according to the present invention, that if the adhesive used for holding pinstripes, decals, side moldings and other adhered items on the paint or other body parts of a vehicle is heated, then it will lose its adhesion and thus release the pinstripes, decals, side moldings and other adhered items from the vehicle without damaging the paint or other body parts of the vehicle.

It has also been discovered, according to the present invention, that if a vehicle adhesive remover having a circular eraser member rotating at high speed is engaged to the various adhered items on a vehicle, then the friction between the rotating eraser member and the adhered items can generate heat which in turn will warm up the adhesive and cause it to lose its adhesion.

It has further been discovered, according to the present invention, that if the high speed rotating eraser member of the vehicle adhesive remover is made of rubber type material, then it will most effectively generate heat when it is frictionally engaged to the adhered items on the body of the vehicle.

It has additionally been discovered, according to the present invention, that if the high speed rotating rubber type eraser member of the vehicle adhesive eraser is rotating at a speed approximately between 3,000 rpm and 4,000 rpm, then the heat generated by its rotational engagement with the adhered items on the body of the vehicle is sufficient to cause the adhesive to substantially lose its adhesion and the adhered items will easily come off without damaging the paint on the vehicle.

It has also been discovered, according to the present invention, that if a specialized metal disc member attached to the rotation shaft of the motor unit is embedded into the rubber type erasing member of the vehicle adhesive remover, then the disc member can best prevent the rubber type erasing member from slipping relative to the rotation shank of the motor unit and can also easily replace worn out eraser members.

It has further been discovered, according to the present invention, that if the eraser unit of the vehicle adhesive remover is designed to be quickly detachable from the motor unit, then a user can use different sized erasers with one motor unit.

It has additionally been discovered, according to the present invention, that if the motor unit of the vehicle adhesive eraser has an air die motor, then it can utilize compressed air as its power source, which is a very popular and convenient power source for the tools used in the automobile manufacture and service industries.

It is therefore an object of the present invention to provide a vehicle adhesive remover, which can cause the adhesive used for adhering pinstripes, decals, side moldings and other adhered items on the paint or other body parts of a vehicle to lose its adhesion, so that the pinstripes, decals, side moldings and other adhered items can be removed from a vehicle without damaging the paint or other body parts of the vehicle.

It is also an object of the present invention to provide a vehicle adhesive remover, which has a circular eraser member rotating at high speed and engaged to the various adhered items on a vehicle, so that the friction between the rotating eraser member of the vehicle adhesive eraser and the adhered items on the vehicle can generate heat which in turn will warm up the adhesive and cause it to lose its adhesion.

It is a further object of the present invention to provide a vehicle adhesive eraser, where the high speed rotating eraser member of the vehicle adhesive remover is made of rubber type material, so that it will most effectively generate heat when it is frictionally engaged to the adhered items on the body of the vehicle.

It is an additional object of the present invention to provide a vehicle adhesive eraser, where the high speed rotating rubber type eraser member of the vehicle adhesive remover is rotating at a speed approximately between 3,000 rpm and 4,000 rpm. Then the heat generated by its rotational engagement with the adhered items on the body of the vehicle is sufficient to cause the adhesive to substantially lose its adhesion and the adhered items will easily come off without damaging the paint on the vehicle.

It is also an object of the present invention to provide a vehicle adhesive eraser, where a specialized metal disc member attached to the rotation shaft of the motor unit is embedded into the rubber type erasing member of the vehicle adhesive remover, so that the disc member can best prevent the rubber type erasing member from slipping relative to the rotation shank of the motor unit.

It is a further object of the present invention to provide a vehicle adhesive eraser, where the eraser unit of the vehicle adhesive remover is designed to be quickly detachable from the motor unit. Then a user can use different sized erasers with one motor unit and can also easily replace worn out eraser members.

It is an additional object of the present invention to provide a vehicle adhesive remover, where the motor unit of the vehicle adhesive eraser has an air die motor, so that it can utilize compressed air as its power source, which is a very popular and convenient power source for the tools used in the automobile manufacture and service industries.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of the present invention portable vehicle adhesive remover having an air die grinder motor unit and a detachable eraser unit.

FIG. 3 is a perspective view of the extending shank of the present invention portable vehicle adhesive remover.

FIG. 4 is a cross-sectional view of the extending shank of the present invention portable vehicle adhesive remover taken along line 4—4 of FIG. 3.

FIG. 5 is an exploded view of the eraser unit of the present invention portable vehicle adhesive remover.

FIG. 6 is a perspective view of the eraser unit of the present invention portable vehicle adhesive remover.

FIG. 7 is a cross-sectional view of the eraser unit of the present invention portable vehicle adhesive remover taken along line 7—7 of FIG. 6.

FIG. 8 is a perspective view of the novel disc member of the eraser unit of the present invention portable vehicle adhesive remover.

DETAILED DESCRIPTION OF THE PREFERRED EMBODIMENT

Figure 2:
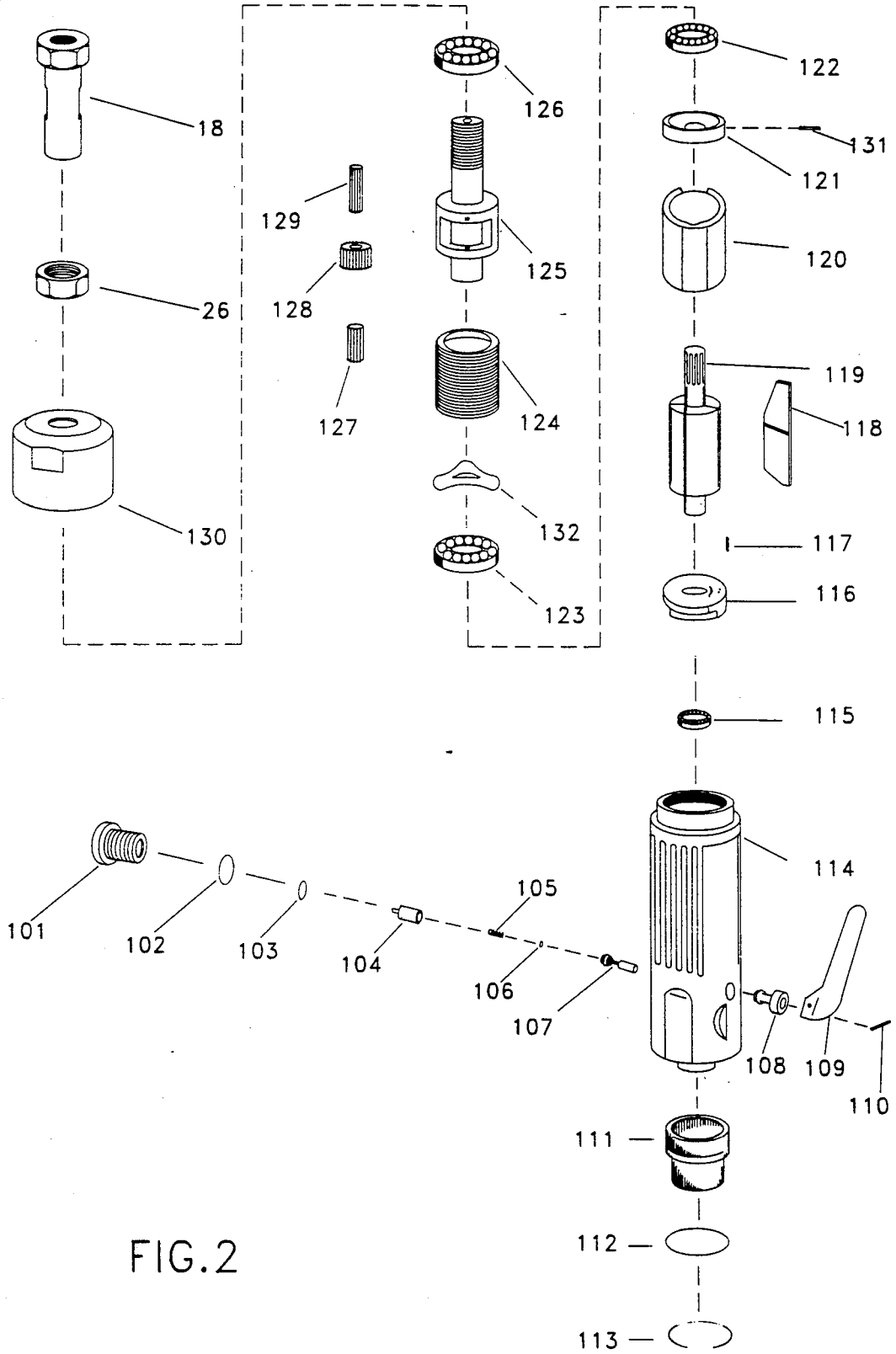
FIG. 2 is an exploded view of the motor unit of the present invention portable vehicle adhesive remover.

Although specific embodiments of the present invention will now be described with reference to the drawings, it should be understood that such embodiments are by way of example only and merely illustrative of but a small number of the many possible specific embodiments which can represent applications of the principle of the invention. Various changes and modifications obvious to one skilled in the art to which the invention pertains are deemed to be within the spirit, scope and contemplation of the invention as further defined in the appended claims.

Referring to FIG. 1, there is shown a perspective view of a portable vehicle adhesive remover 10. It has a motor unit 12 which has an air exhaust port 14 and a throttle control lever 16 at the bottom end, and a rotatable extending shank 18 at the top end. An eraser unit 20 is detachably attached to rotatable shank 18. Eraser unit 20 has a disc shaped rubber eraser member 22 having a flat transverse erasing surface 24. Rotatable extending shank 18 may be detached by using pliers to hold both the nut 26 of motor unit 12 and the nut 28 of extending shank 18 and then turn them in opposite directions. Eraser unit 20 can be detached by hand holding rubber eraser member 22 and holding top nut 28 of extending shank 18 with a pair of pliers and then turning them in opposite directions.

Referring to FIG. 2, there is shown an exploded view of motor unit 12 of portable vehicle adhesive remover 10. Motor unit 12 has a hollow cylindrical housing 114. Near the bottom end of housing 114 there are two opposite side openings and one bottom opening. An air exhaust sleeve 111 is attached to the bottom opening with an "O" ring 112 and a retainer ring 113 inserted. A throttler assembly is assembled inside the bottom portion of housing 114, a rotor assembly is assembled inside the middle portion of housing 114, and a gear assembly is assembled inside the top portion of housing 114.

The throttler assembly includes an air regulator 104, a valve stem 107 and a valve bushing 108. One end of valve stem 107 is inserted with a spring 105 into air regulator 104 with an "O" ring 106, so that spring 105 tends to push valve stem 107 out to block the air passage through air regulator 104. The other end of valve stem 107 is stuck out from one of the side openings through valve bushing 108 which is in turn mounted on the side of housing 114 at the side opening. Air regulator 104 is assembled inside housing 114 and supported by a valve screw 101 with an "O" ring 103 inserted which is in turn mounted on the side of housing 114 at the other opposite side opening with an "O" ring 102 inserted. A throttle lever 109 is attached by a roll pin 110 to the side of housing 114 near the bottom end against the stuck out end of valve stem 107.

The rotor assembly includes a cylinder 120 and a rotor 119 which has four side slots with blades 118 mounted respectively. Rotor 119 is supported by front ball bearing 122 and rear ball bearing 115 and assembled inside cylinder 120. Front end plate 121 and rear end plate 116 are assembled to the respective ends of cylinder 120 by two roll pins 131 and 117 respectively.

The gear assembly includes an internal gear 124 and planet cage 125 which has two side slots with planet gears 128 mounted respectively by planet pins 129. Planet cage 125 is supported by two ball bearings 126 and 123 and assembled inside internal gear 124 with a wave washer 132 and two idle gears bushings 127 engaged with the two planet gears 128 respectively.

Finally a housing cap 130 is screwed on top of housing 114 and the upper shaft of the planet cage sticks out from the top opening of housing cap 130 for receiving a cap nut 26 and a hollow extending shank. Shown in detail in FIGS. 3 and 4, extending shank 18 has inner screw threads 51 and 53 at its upper end 52 and lower end 54 respectively. The inner screw threads 51 at upper end 52 of extending shank 18 receives the eraser unit shown in FIG. 6. Lower end 54 of extending shank 18 is threaded onto the stuck out upper shaft of planet cage 125 of the gear assembly by lower threads 53. The outer periphery of the upper end of extending shank 18 is configured as a nut 28 for accommodating a pair of pliers. The outer periphery of the middle portion of extending shank is also configured to have two oppositely disposed flat surfaces 56 and 58 for accommodating a pair of pliers.

Referring now to FIGS. 5–8, there is shown the eraser unit 20 of the present invention portable vehicle adhesive remover 10. FIG. 5 is an exploded view of eraser unit 20, FIG. 6 is a perspective view of eraser unit 20, FIG. 7 is a cross-sectional view of eraser unit 20 taken along line 7—7 of FIG. 6, and FIG. 8 is a perspective view of the novel disc member of eraser unit 20.

Eraser unit 20 has a disc-shaped rubber eraser member 22 having a flat top erasing surface 24, and a disc member 30 embedded inside eraser member 22. Disc member 30 includes a disc 32 having a central opening 34 and two rim notches 36 and 38, a bolt 40 having an elongated shaft 42, a washer 44 and a nut 46. The elongated shaft 42 of bolt 40 extends through the central opening 34 of disc 32 and is secured by nut 46 with washer 44 inserted. When molding the rubber eraser member 22 with the disc member embedded, the rubber material will fill in the two rim notches 36 and 38 of disc 30, so that rubber eraser member 22 will not slip relative to disc 30 during rotational motion. After molding, only the elongated shaft 42 of bolt 40 is exposed out of rubber eraser member 22, which is in turn engaged with the upper end 52 of extending shank 28 of motor unit 12.

When high pressure compressed air is sent into the bottom end 14 of motor unit 12 and throttle control lever 16 is pressed, the compressed air will be gushed into the rotor assembly through the throttler assembly and blow blades 118 to make rotor 119 rotate, which in turn drives extending shank 18 to rotate through the gear assembly. Consequently rubber eraser member 22 is rotated by embedded disc member 30, and its erasing surface 24 can be engaged to pinstripes, decals, side moldings and other adhered items on vehicle bodies. By using pliers eraser unit 20 can be detached from motor unit 12, which enables a user to use alternative eraser units having different sized erasing surfaces with one motor unit. When the rubber erasing member is engaged to the vehicle pinstripes or decals or the adhesive holding side molding to a vehicle, the high velocity rotation of the rubber erasing member will generate adequate heat to cause the vehicle adhesive to lose its adhesion and thus release the pinstripes, decals, side moldings and other adhered items, so the pinstripes, decals, side moldings and other adhered items can be removed by the rubber erasing member without damaging the paint or other body parts of the vehicle.

Like any standard rubber eraser, the rubber portion of the eraser member of the present invention vehicle adhesive remover will be used up in extensive usage. However, as the rubber portion of the rubber erasing member is worn out, the whole eraser unit 20 can be easily detached from the motor unit 12 and be replaced. Preferably the rubber material of the eraser member is 45 degree in hardness, and the disc shaped rubber member is three and half inches in diameter.

The novel feature of the present invention portable remover is that, unlike the conventional tools designed for removing the pinstripes, decals, side moldings and other adhered items, the present invention remover does not remove the pinstripes, decals, side moldings and other adhered items by physically deteriorating, destroying or disintegrating them which often results in damaging the original paint or other body parts of the vehicle, but rather removes the pinstripes, decals, side moldings and other adhered items by using a high speed rotating rubber eraser to generate adequate heat to cause the adhesive to lose its adhesion and thus release the pinstripes, decals, side moldings and other adhered items, so they will come off without damaging the paint or other body parts of the vehicle.

The present invention vehicle adhesive remover can be used to remove anything adhered onto the vehicle by vehicle adhesives. As mentioned above, it can be used to remove pinstripes, decals, side moldings, etc. Sometimes when a side molding is pulled off a vehicle, it was held on by a two-sided adhesive. The present invention adhesive remover can also remove this type of two-sided adhesive effectively. In addition, the present invention vehicle adhesive remover can be used to remove other items adhered on various parts of the body of a vehicle, such as factory stickers adhered on certain parts of the vehicle, or price tickets and advertising slips adhered on the glass windows of the vehicle.

The present invention adhesive remover has many advantages including: (a) it uses safe, convenient and harmless compressed air as its power source; (b) it is a light and small portable device; (c) it increases the speed of the process of removing various adhered items of a vehicle, yet reduces its difficulty; (d) it leaves no damage on the original paint or body part of the vehicles; and (e) the eraser unit is detachable so different sized eraser units may be used with a common motor unit.

Defined in detail, the present invention is a portable vehicle adhesive remover comprising: (a) a generally cylindrical shaped hollow housing having a top end with a top opening, a bottom end with a bottom opening, a middle portion, a first side opening and an opposite second side opening adjacent to the bottom end; (b) an air exhaust sleeve mounted to said bottom end of said housing at said bottom opening with a first "O" ring and a retainer ring inserted; (c) a throttler assembly assembled inside said housing adjacent to its said bottom end including an air regulator, a valve stem having an inner end and an outer end, and a valve bushing, where the air regulator is supported by a valve screw with a third "O" ring inserted, which valve screw is in turn mounted on said housing at its said first side opening with a second "O" ring inserted, the inner end of the valve stem is inserted with a spring into the air regulator with a fourth ring inserted, so that the spring tends to push the valve stem out to block air passage through the air regulator, and the outer end of the valve stem extends out from said second side opening of said housing through the valve bushing which is in turn mounted on said housing at its said second side opening; (d) a throttle lever pivotally mounted to said housing adjacent to its said bottom end by a first roll pin and against the extended outer end of said valve stem of said throttler assembly, such that when the throttle lever is pressed, said valve stem of said throttler assembly is pressed into said air regulator of said throttler assembly to permit air passage; (e) a rotor assembly assembled inside said middle portion of said housing including a cylinder having a front end and a rear end, a rotor with four rotor blades, a first ball bearing, a second ball bearing, a front end plate and a rear end plate, where the rotor and the rotor blades are assembled inside the cylinder and supported by the first and second ball bearings, and the front and rear end plates are attached to the front and rear ends of the cylinder by a second roll pin and a third roll pin respectively; (f) a gear assembly assembled inside said housing adjacent to its said top end including an internal gear, a planet cage having an elongated spindle, two planet gears mounted to the planet cage by two planet pins respectively, two idle gear bushings, a third ball bearing, a fourth ball bearing and a fastening nut, where the planet cage with the two planet gears and two idle gear bushings are engaged with the internal gear and supported by the third and fourth ball bearings with a wave washer inserted, and the fastening nut is threaded onto the elongated spindle of the planet cage; (g) a housing cap having a central opening mounted to said top end of said housing at said top opening with a portion of said fastening nut and a portion of said elongated spindle of said planet cage of said gear assembly extended out from the central opening of the housing cap; (h) an extending shank having a generally cylindrical hollow body with inner screw threads and two oppositely disposed flat outer surfaces, a proximal end threaded onto said elongated spindle of said planet cage of said gear assembly and a distal end configured as a nut; and (i) an eraser unit mounted to said extending shank including a generally disc shaped resilient eraser member having a round flat erasing surface, and a disc member embedded in the eraser member, where the disc member is assembled by a disc having a central opening for receiving a bolt and two oppositely disposed rim notches for preventing the eraser member from slipping, and the bolt has an elongated shaft extended through the central opening of the disc and fastened by an embedded nut, such that the elongated shaft of the bolt extends out from the eraser member and can be threaded into said distal end of said extending shank; (j) whereby said portable adhesive remover can be energized by a high pressure compressed air source and cause said resilient eraser member to rotate at a high speed, and when said resilient eraser member is engaged to the pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

In the preferred embodiment of the present invention defined in detail: (a) the resilient eraser member is made of rubber material; and (b) the diameter of the round flat erasing surface of the resilient eraser member is approximately three and a half inches.

Defined broadly, the present invention is a portable vehicle adhesive remover comprising: (a) a hollow housing having a top end with a top opening, a bottom end with a bottom opening and a middle portion; (b) a throttler means including an air valve assembled inside said housing adjacent to its said bottom end and a throttle lever pivotally mounted to said housing adjacent to its said bottom end for regulating air passage; (c) a rotor means including a rotor rotatably supported by a first pair of ball bearings assembled inside said housing at its said middle portion; (d) a gear means including an internal gear and a planet cage having an elongated spindle supported by a second pair of ball bearings assembled inside said housing adjacent to its said top end; (e) a housing cap having an opening mounted to said top end of said housing and a cap nut threaded onto said elongated spindle of said planet cage of said gear means, such that a portion of the cap nut and a portion of said elongated spindle of said planet cage of said gear means extends out from the central opening of the housing cap; (f) an extending shank having a proximal end attached to said elongated spindle of said planet cage of said gear means and a distal end configured as a nut; and (g) an eraser unit mounted to said extending shank including a resilient eraser member having an erasing surface, and a disc member embedded in the eraser member, where the disc member includes a disc having rim notches for preventing the eraser member from slipping and an elongated shaft extended out from the eraser member and removably attached to said distal end of said extending shank; (h) whereby said portable adhesive remover can be energized by a high pressure compressed air source and cause said resilient eraser member to rotate at a high speed and when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

Defined more broadly, the present invention is a portable vehicle adhesive remover comprising: (a) a housing having a top opening and a bottom opening; (b) a motor unit assembled inside said housing including a throttler means located adjacent to said bottom end, a gear means located adjacent to said top end and a rotor means located in between the throttler means and the gear means, the motor unit having an elongated spindle extending out from said top opening of said housing; (c) an extending shank having a proximal end attached to said elongated spindle of said motor unit, and a distal end; and (d) an eraser unit removably attached to said distal end of said extending shank including a resilient eraser member and a disc member embedded in the eraser member; (e) whereby said portable adhesive remover can be energized by a high pressure compressed air source and cause said resilient eraser member to rotate at a high speed and when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

Defined even more broadly, the present invention is a portable vehicle adhesive remover comprising: (a) a motor unit having an elongated spindle; (b) an extending shank having a proximal end attached to said elongated spindle of said motor unit, and a distal end; and (c) an eraser unit removably attached to said distal end of said extending shank including a resilient eraser member and a disc member embedded in the eraser member; (d) whereby said portable adhesive remover can be energized by high pressure compressed air source and cause said resilient eraser member to rotate in a high speed; when said resilient eraser member is engaged to the pinstripes, decals, side moldings and other adhered items on a vehicle, it can generate adequate heat to cause the adhesive to lose its adhesion and thus release the pinstripes, decals, side moldings and other adhered items, so they can be removed without damaging the paint or other body parts of the vehicle.

Defined most broadly, the present invention is a portable vehicle adhesive remover comprising a motor unit and an eraser unit, the eraser unit including a resilient eraser member and a disc member embedded in the eraser member removably attached to the motor unit, whereby said motor unit can rotate said eraser unit, so that when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

Defined alternatively in detail, the present invention is an eraser assembly for a portable vehicle adhesive remover having an air die grinder motor unit with an elongated spindle, comprising: (a) an extending shank having a generally cylindrical hollow body with inner screw threads and two oppositely disposed flat outer surfaces, a proximal end threaded onto said elongated spindle of said motor unit and a distal end configured as a nut; and (b) an eraser unit including a generally disc shaped resilient eraser member having a round flat erasing surface and a disc member embedded in the eraser member, where the disc member is assembled by a disc having a central opening for receiving a bolt and two oppositely disposed rim notches for preventing the eraser member from slipping, and the bolt has an elongated shaft extended through the central opening of the disc and fastened by an embedded nut, such that the elongated shaft of the bolt extends out from the eraser member and can be threaded into said distal end of said extending shank; (c) whereby said portable adhesive remover can be energized by a high pressure compressed air source and cause said resilient eraser member to rotate at a high speed, and when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

In the preferred embodiment of the present invention defined alternatively in detail: (a) the resilient eraser member is made of rubber material; and (b) the diameter of the round flat erasing surface of the resilient eraser member is approximately three and a half inches.

Alternatively defined broadly, the present invention is an eraser assembly for a portable vehicle adhesive remover having an air die grinder motor unit with an elongated spindle, comprising: (a) an extending shank having a proximal end attached to said elongated spindle of said motor unit and a distal end configured as a nut; and (b) an eraser unit including a resilient eraser member having an erasing surface and a disc member embedded in said eraser member, where the disc member includes a disc having rim notches for preventing said eraser member from slipping, and an elongated shaft extended out from said eraser member and removably attached to said distal end of said extending shank; (c) whereby said portable adhesive remover can be energized by a high pressure compressed air source and cause said resilient eraser member to rotate at a high speed, and when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

Alternatively defined more broadly, the present invention is an eraser assembly for a portable vehicle adhesive remover having an air die grinder motor unit with an elongated spindle, comprising: (a) an extending shank having a proximal end attached to said elongated spindle of said motor unit, and a distal end; and (b) an eraser unit removably attached to said distal end of said extending shank including a resilient eraser member and a disc member embedded in the eraser member; (c) whereby said portable adhesive remover can be energized by a high pressure compressed air source and cause said resilient eraser member to rotate at a high speed, and when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

Alternatively defined even more broadly, the present invention is an eraser assembly for a portable vehicle adhesive remover having a motor unit, comprising: (a) an eraser unit including a resilient eraser member and a disc member embedded in the eraser member; and (b) an extending shank interconnecting said motor unit and said eraser unit; (c) whereby said portable adhesive remover can be energized by a high pressure compressed air source and cause said resilient eraser member to rotate at a high speed, and when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

Alternatively defined most broadly, the present invention is an eraser assembly for a portable vehicle adhesive remover having a motor unit, comprising an eraser unit including a resilient eraser member and a disc member embedded in the eraser member detachably attached to the motor unit, whereby said motor unit can rotate said eraser unit, so that when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. A portable vehicle adhesive remover comprising:

a. a hollow housing having a top end with a top opening, a bottom end with a bottom opening and a middle portion with a first side opening and a second opposite side opening both located adjacent to the bottom end, and an air exhaust sleeve mounted to the bottom end at the bottom opening with a first "O" ring inserted;

b. a throttler means including an air valve assembled inside said housing adjacent to its said bottom end and a throttle lever pivotally mounted to said housing adjacent to its said bottom end by a first roll pin for regulating air passage, and further including an air regulator, a valve stem having an inner end and an outer end, and a valve bushing, where the air regulator is supported by a valve screw with a third "O" ring inserted, which valve screw is in turn mounted on said housing at its said first side opening with a second "O" ring inserted, the inner end of the valve stem is inserted with a spring into the air regulator with a fourth "O"ring inserted, so that the spring tends to push the valve stem out to block air passage through the air regulator, and the outer end of the valve stem extends out from said second side opening of said housing through the valve bushing which is in turn mounted on said housing at its said second side opening;

c. a rotor means including a rotor rotatably supported by a first pair of ball bearings assembled inside said housing at its said middle portion, and further including a cylinder with two opposite ends and a pair of end plates attached to the two opposite ends of the cylinder by a second roll pin and a third roll pin respectively;

d. a gear means including an internal gear and a planet cage having an elongated spindle supported by a second pair of ball bearings assembled inside said housing adjacent to its said top end, where the planet cage is engaged with the internal gear and supported by the second pair of ball bearings with a wave washer inserted;

e. a housing cap having an opening mounted to said top end of said housing and a cap nut threaded onto said elongated spindle of said planet cage of said gear means, such that a portion of the cap nut and a portion of said elongated spindle of said planet cage of said gear means extends out from the central opening of the housing cap;

f. an extending shank having a proximal end attached to said elongated spindle of said planet cage of said gear means and a distal end configured as a nut; and g. an eraser unit mounted to said extending shank including a resilient eraser member having an erasing surface, and a disc member embedded in the eraser member, where the disc member includes a disc having rim notches for preventing the eraser member from slipping and an elongated shaft extending out from the eraser member and removably attached to said distal end of said extending shank;

h. whereby said portable adhesive remover can be energized by a high pressure compressed air source and cause said resilient eraser member to rotate at a high speed, and when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

2. The invention as defined in claim 1 wherein said resilient eraser member is made of rubber material.

3. The invention as defined in claim 1 wherein said erasing surface of said resilient eraser member is flat and round.

4. A portable vehicle adhesive remover comprising;

a. a generally cylindrical shaped hollow housing having a top end with a top opening, a bottom end with a bottom opening, a middle portion, a first side opening and an opposite second side opening adjacent to the bottom end;

b. an air exhaust sleeve mounted to said bottom end of said housing at said bottom opening with a first "O" ring and a retainer ring inserted;

c. a throttler assembly assembled inside said housing adjacent to its said bottom end including an air regulator, a valve stem having an inner end and an outer end, and a valve bushing, where the air regulator is supported by a valve screw with a third "O" ring inserted, which valve screw is in turn mounted on said housing at its said first side opening with a second "O" ring inserted, the inner end of the valve stem is inserted with a spring into the air regulator with a fourth "O" ring inserted, so that the spring tends to push the valve stem out to block air passage through the air regulator, and the outer end of the valve stem extends out from said second side opening of said housing through the valve bushing which is in turn mounted on said housing at its said second side opening;

d. a throttle lever pivotally mounted to said housing adjacent to its said bottom end by a first roll pin and against the extended outer end of said valve stem of said throttler assembly, such that when the throttle lever is pressed, said valve stem of said throttler assembly is pressed into said air regulator of said throttler assembly to permit air passage;

e. a rotor assembly assembled inside said middle portion of said housing including a cylinder having a front end and a rear end, a rotor with four rotor blades, a first ball bearing, a second ball bearing, a front end plate and a rear end plate, where the rotor and the rotor blades are assembled inside the cylinder and supported by the first and second ball bearings, and the front and rear end plates are attached to the front and rear ends of the cylinder by a second roll pin and a third roll pin respectively;

f. a gear assembly assembled inside said housing adjacent to its said top end including an internal gear, a planet cage having an elongated spindle, two planet gears mounted to the planet cage by two planet pins respectively, two idle gear bushings, a third ball bearing, a fourth ball bearing and a fastening nut, where the planet cage with the two planet gears and two idle gear bushings are engaged with the internal gear and supported by the third and fourth ball bearings with a wave washer inserted, and the fastening nut is threaded onto the elongated spindle of the planet cage;

g. a housing cap having a central opening mounted to said top end of said housing at said top opening with a portion of said fastening nut and a portion of said elongated spindle of said planet cage of said gear assembly extended out from the central opening of the housing cap;

h. an extending shank having a generally cylindrical hollow body with inner screw threads and two oppositely disposed flat outer surfaces, a proximal end threaded onto said elongated spindle of said planet cage of said gear assembly and a distal end configured as a nut; and i. an eraser unit mounted to said extending shank including a generally disc shaped resilient eraser member having a round flat erasing surface, and a disc member embedded in the eraser member, where the disc member is assembled by a disc having a central opening for receiving a bolt and two oppositely disposed rim notches for preventing the eraser member from slipping, and the bolt has an elongated shaft extended through the central opening of the disc and fastened by an embedded nut, such that the elongated shaft of the bolt extends out from the eraser member and can be threaded into said distal end of said extending shank;

j. whereby said portable adhesive remover can be energized by a high pressure compressed air source and cause said resilient eraser member to rotate at a high speed, and when said resilient eraser member is engaged to pinstripes, decals, side moldings and other adhered items on a vehicle, said resilient eraser member can generate adequate heat to cause the adhesive to lose its adhesion and thus release the pinstripes, decals, side moldings and other adhered items, so they can be removed without damaging the paint or other body parts of the vehicle.

5. The invention as defined in claim 4 wherein said resilient eraser member is made of rubber material.

6. The invention as defined in claim 4 wherein said resilient eraser member rotates at a speed between 3000 rpm and 4000 rpm.

* * * * *